United States Patent [19]

Zeller-Pendrey

[11] Patent Number: 4,477,562

[45] Date of Patent: Oct. 16, 1984

[54] DRY STRIP ANTIHALATION LAYER FOR PHOTOTHERMOGRAPHIC FILM

[75] Inventor: Jeanine I. Zeller-Pendrey, Woodbury, Minn.

[73] Assignee: Minnesota Mining and Manufacturing Company, St. Paul, Minn.

[21] Appl. No.: 497,573

[22] Filed: May 24, 1983

[51] Int. Cl.[3] ..... G03C 1/78

[52] U.S. Cl. ..... 430/513; 430/510; 430/514; 430/517; 430/348; 430/350; 430/617

[58] Field of Search ..... 430/510, 513, 514, 517, 430/271, 348, 350, 617

[56] References Cited

U.S. PATENT DOCUMENTS

| | | | |
|---|---|---|---|
| 3,453,111 | 7/1969 | Yackel | 430/513 |
| 3,457,075 | 7/1969 | Morgan et al. | 96/67 |
| 3,619,335 | 11/1971 | Bryan | 161/1 |
| 3,779,771 | 12/1973 | Gatzke | 430/514 |
| 3,839,049 | 7/1972 | Simons | 96/114.6 |
| 3,994,732 | 11/1976 | Winslow | 96/114.1 |
| 4,271,263 | 6/1981 | Gottert | 430/513 |
| 4,308,379 | 12/1981 | Goettert | 542/457 |
| 4,311,787 | 1/1982 | Lemahieu et al. | 430/513 |
| 4,376,162 | 3/1982 | Kawata et al. | 430/513 |
| 4,409,316 | 10/1983 | Zeller-Penprey | 430/513 |

FOREIGN PATENT DOCUMENTS 1261102 1/1972 United Kingdom .

*Primary Examiner*—Jack P. Brammer

*Attorney, Agent, or Firm*—Donald M. Sell; James A. Smith; Lorraine R. Sherman

[57] ABSTRACT

A photothermographic element having a strippably-adhered, radiation-absorbing, antihalation layer is disclosed. The element comprises at least one imageable layer adhered to one surface of a support base, and an antihalation layer having a resistance greater than 1500 ohms per square, strippably adhered to any exposed surface of said element, said antihalation layer having a delaminating resistance in the range of 6 to 50 g/cm, a layer strength in g/cm greater than its delaminating resistance, and an optical density of at least 0.1.

12 Claims, No Drawings

DRY STRIP ANTIHALATION LAYER FOR PHOTOTHERMOGRAPHIC FILM

TECHNICAL FIELD

The present invention relates to a photothermographic imaging element, preferably of the "dry silver" type. The photothermographic imaging element contains a dry-strippable, radiation-absorbing, antihalation layer.

BACKGROUND ART

Photothermographic imaging systems are those imaging materials which, upon first being exposed to light in an imagewise fashion, produce an image when subsequently heated. The exposure to light or other radiation photoactivates or photodeactivates a component in the imageable element and subsequent heating causes an image forming reaction to differentially occur in exposed and unexposed regions.

Photothermographic imaging systems of the dry silver type are described in U.S. Pat. Nos. 3,457,075; 3,839,049 and 3,994,732. These imageable systems comprise a silver source material (usually an organic silver salt, e.g., a silver salt of an organic long chain fatty carboxylic acid, or a complexed silver salt), silver halide in catalytic proximity to the silver source material, a reducing agent for silver ion, and a binder. It is because the exposure and development of the imaging systems occur without using water, that these materials are often referred to as dry silver, light-sensitive materials.

In order to improve the sharpness or definition of photographic images an antihalation layer is often incorporated into photosensitive compositions. To be effective, the active ingredient in the antihalation layer will absorb at the wavelengths at which the photosensitive composition is sensitive. The longer the path length of the light in the layer of light-sensitive composition, the greater the attenuation. Therefore, scattered light is attenuated or absorbed to a larger extent than light which impinges directly on a light-sensitive crystal. As a result, although the overall speed of the composition is reduced slightly, scattered light and other light rays which are liable to produce a blurred image are preferentially absorbed and so the overall definition and sharpness of images produced in the layer are increased.

Antihalation compounds, known in the art as acutance agents, are dyes that are frequently incorporated into photosensitive systems. Preferably they are heat labile in the system, that is to say, they are degraded by the heat development of the photothermographic composition to one or more compounds which are substantially colorless. The exact mechanism of this reaction is not known. Such acutance agents are disclosed in, for examples, in U.S. Pat. No. 4,308,379.

British Patent Specification No. 1,261,102 discloses a transparent heat-developable photosensitive sheet material in which acutance is improved by incorporating relatively large proportions of colored material in a layer separate from the sensitive coating, which layer may be removed in a dry stripping process. On page 2, lines 28 to 44, methods are taught for stripping the color layer from the construction, such methods involving use of a pressure-sensitive adhesive tape on a corner or edge, or more effectively, supplying a thin coating of thermoplastic adhesive over the color layer and pressing the coating into contact with a sheet of paper during the required heat-development of the latent image. It is evident that the strippable layer was removed with difficulty.

A resistively heatable photothermographic element is disclosed in pending U.S. patent application Ser. No. 352,648, filed Feb. 26, 1982. The photothermographic element is provided with a two-layered strippable coating which has electrical resistivity in the range of 60 to 1500 ohms/square. The elements may be exposed to radiation and then thermally developed by applying a voltage across the strippable coating which becomes resistively heated. After development, the strippable coating may be removed.

Dry-strippable layers (which are adhered to glass or metal, for example) are known in the art. U.S. Pat. No. 3,619,335 relates to a unitary laminate comprising a backing layer which incorporates a radiation absorber, such as carbon black, dyes, and high atomic weight metals. The flexible polymeric film is strippably adhered to the backing layer by an intermediate adhesive layer. No mention is made in this patent of a laminate being useful in a photothermographic element.

SUMMARY OF THE INVENTION

Briefly, the present invention provides a photothermographic element, preferably of the dry silver type, having a strippably-adhered, radiation-absorbing, antihalation layer on the back side of the element, or in another embodiment, overlying the photosensitive layer. Such an element has improved film integrity and may have a simpler formulation (particles to reduce resistivity are not added) compared to the elements disclosed in the above-mentioned U.S. Ser. No. 352,648, British Patent Specification No. 1,261,102, and U.S. Pat. No. 3,619,335. The radiation-absorbing layer of the present invention is strippable as an integral layer by peeling off the photothermographic element. The strippable layer may itself be multi-layered but preferably it is of unitary-layer construction.

The present invention overcomes the halation problem known to exist in dry silver films (i.e., light spreading beyond its proper boundaries and the developed photographic image not being sharp) which have heretofor precluded their acceptance for use in high quality applications. Also, it is advantageous to have the antihalation agent in a separate strippable layer rather than in an imageable layer so as to avoid stain in the imaged area. Further, no liquid is necessary in the present invention to remove the antihalation agents.

In the present invention:

"strippably adhered" means, as is well understood in the art, that the layers are sufficiently well adhered to each other to survive mild handling without the layers completely separating and yet still be separable from each other by hand when required. This generally means that a force (delaminating resistance) of about 6 to 50 g/cm width (0.5 to 4.5 ounces per inch width) of layer is needed to separate the two layers when one layer is pulled at 180° from the other at about 229 cm (90 inches) per minute. Preferably this peel force is in the range of 11 to 33 g/cm width (1 to 3 ounces per inch width);

"layer strength" means the downstrip stress on an antihalation layer (without substrate) that just tears the layer when a weight is applied thereto, the weight being increased to the point where it tears the layer; and "delaminating resistance" means the force needed to separate a layer from a substrate.

DETAILED DESCRIPTION

The present invention provides a photothermographic element comprising (1) at least one imageable layer adhered to one surface of a support base and (2) a radiation-absorbing, antihalation layer having a resistance greater than 1500 ohms per square, preferably greater than 5000 ohms per square, strippably adhered to any exposed surface of the construction, which exposed surface preferably is the backside of the support base, said antihalation layer having a delaminating resistance of 6 to 50 g/cm and a layer strength greater than, preferably at least two times greater than, its delaminating resistance.

The photothermographic portion of the element can be any imageable layer or layers which are photosensitive and developable by being heated (e.g., on a heated drum roll or by exposure to infrared radiation) in the temperature range of 150 to 350° F. (approximately 65 to 180° C.). The most common photothermographic systems of this type are (1) silver halide photothermographic systems comprising silver halide, a silver source material in catalytic proximity to the silver halide, and a reducing agent for silver ion in a binder, (2) thermal diazonium photothermographic systems comprising an acid-stabilized diazonium salt, an azo-coupling compound and a base or base-generating material in a binder, (3) dye-bleach photothermographic systems comprising a photosensitive bleach-producing or bleach-removing material and a dye in a binder, and (4) leuco dye oxidation photothermographic systems comprising a leuco dye oxidizable to a colored state, a photosensitive material which generates an oxidizing agent or a photosensitive oxidizing agent that decomposes when light struck. Other systems such as photosensitive materials which color upon a photoinitiated change in pH or photoinitiated coupling are also known and included in the term photothermographic systems. These systems may be in a single layer or in a plurality of layers as is well known in the art. Most preferred are the silver halide photothermographic systems, so-called dry silver systems.

The support base or substrate is a transparent polymeric film. Preferably it is made of such materials as polyester [e.g., poly(ethyleneterephthalate)], cellulose ester (e.g., cellulose acetate, cellulose acetate butyrate, cellulose acetate propionate), polyolefins, polyvinyl resins, and the like.

The radiation-absorbing, antihalation layer, which preferably has a unitary layer construction to provide economy of production, has a resistance of greater than 1500 ohms per square, preferably greater than 5000 ohms per square, and can be a binder resin containing any dye, pigment, or combination thereof which does not cause the resistivity of the construction to fall as low as 1500 ohms. Typically, the resin component of the antihalation layer provides insulating characteristics to provide a resistance greater than 1500 ohms per square.

The pigments or dyes incorporated in the antihalation layer overcome the halation problem which, as has been mentioned above, is often encountered with imaging materials. Pigments and dyes which absorb within specific regions of the electromagnetic spectrum (i.e., regions in which the photothermographic material is sensitive) provide panchromatic antihalation properties to the element. Thus the strippable layer can be transparent, translucent or opaque. A white background (e.g., by using titanium dioxide or zinc oxide as a filler) can even be provided. The layer should absorb radiation between 380 and 800 nm. The minimum optical density may be measured over this entire spectral range or over any 50 nm portion within the range.

The antihalation layer consists of at least two components, i.e., a resin component and a radiation-absorbing agent. The binder or resin of the antihalation/resistive layer may be any material which provides the physical properties necessary (i.e., the structural integrity of the strippable layer is maintained during the stripping procedure). The resin component may be a single resin or a combination of resins. Such resins as polyesters, polyamides, polyolefins polyvinylchloride, polyethers, polycarbonates, gelatin, cellulose esters, polyvinyl acetals and the like, are all useful. Preferred resins include the following: polyvinyl butyrals, polyvinyl alcohols, methyl methacrylate, ethyl methacrylate, ethyl methyl methacrylate, cellulose acetate, cellulose acetate ester, cellulose acetate propionate, and cellulose acetate butyrate. These resins when dissolved in any compatible organic solvent system (such as methyl ethyl ketone, acetone, toluene, or alcohols) provide a characteristic film-forming layer when coated on a support at a level in the range of 7.5 g/m$^2$ to 21.5 g/m$^2$ (0.7 g/ft$^2$ to 2 g/ft$^2$). To enhance the film-forming characteristics of the antihalation layer, surfactants or plasticizers (in the range of 3 to 40 weight percent) are used which can include, for example, alkyl aryl ether alcohols such as alkyl arylpolyether alcohol (e.g., octyl phenoxy polyethoxy ethanol and nonyl phenoxy polyethoxy ethanol); polypropylene glycols, such as m. wt. 1025 polypropylene glycol; and phthalatic anhydride esters, such as dibutyl phthalate and dioctyl phthalate.

Antihalation, radiation absorbing agents are dispersed throughout the film-forming layer in a quantity sufficient to provide the layer with an optical density of at least 0.1, and preferably at least 0.3 to 2.0. These agents can be dyes or pigments which absorb panchormatically or at specific wavelengths and are soluble in the resin solvent system. Any antihalation material compatible with the resin and solvent systems of the antihalation layer can be used in the present invention. Examples of antihalation agents useful in the present invention are shown in TABLE I.

TABLE I

| Dye or pigment | Av. diam. of particle |
|---|---|
| (1) carbon black; such as furnace, gas, and lamp black | 10 to 300 millimicrons |
| (2) graphite | 10 to 300 millimicrons |
| (3) titanium dioxide | 10 to 300 millimicrons |
| (4) Color Index Solvent Red 96 (Ciba-Geigy) | molecular |
| (5) Color Index Solvent Blue 22 | molecular |
| (6) Color Index Solvent Blue 43 | molecular |
| (7) Color Index Solvent Red 39 | molecular |
| (8) Color Index Basic Blue 7 | molecular |
| (9) Color Index Victoria Pure Blue | molecular |

The radiation absorber of the present invention is compatible with the spectral sensitization of the photothermographic element to enhance acuity. The amount of pigment or dye included for absorbing panchromatically is sufficient to provide an optical density of the imaged material of at least 0.1, preferably at least 0.3 to 2.0, as measured by an optical transmission densitometer. Too high a level of pigment, such as carbon, can weaken the structual integrity of the strippable antihalation layer. In some cases, as where a very strong strippable layer is desired, it may be preferred to use a dye as the antihalation agent.

The preferred antihalation layers of the present invention comprise pigments such as carbon black, graphite, and titanium dioxide, or dyes such as Orasol TM Red 2B (Ciba Geigy), and Victoria Pure Blue. The most preferred antihalation material is a radiation-absorber such as carbon black of average particle size up to 50 microns in diameter, preferably of 5 to 10 microns or less, and most preferably of 1 to 2 microns.

The antihalation layer preferably is strippably bonded to the backside of the support base. This can be readily accomplished by a variety of means. For example, the antihalation layer may be coated out of solution onto the support base, with appropriate resins having been selected for the base and the resistive layer which have only a limited natural affinity for each other. To that end, combinations of poly(ethyleneterephthalate) and cellulose esters, polyesters and polyamides, and polyamides and polyvinyl acetals would provide only limited strength bonding between layers so that the resistive layer could be stripped from the backside of the support base. The antihalation layer is self-adherent to the support base. No additional adhesive is required.

The strip-sheet strength of the antihalation layer of the present invention is superior to that known in the art, the strip-sheet being able to withstand stress-fracturing and does not need tape to facilitate single sheet removal.

The photothermographic element of the present invention is useful as a graphic arts or photocomposition film and in other high acutance applications.

Objects and advantages of this invention are further illustrated by the following examples, but the particular materials and amounts thereof recited in these examples, as well as other conditions and details, should not be construed to unduly limit this invention.

EXAMPLE 1

A photothermographic element was constructed comprising a support base of 4 mil thick ($1.02\times10^{-4}$m) poly(ethylene terephthalate) base coated with a first layer comprising 12.5 parts silver behenate, 375 parts of polyvinyl butyral, 46 parts 1-methyl-2-pyrrolidinone, 0.25 parts HBr and 0.10 parts HI, 0.20 parts $HgBr_2$, 0.08 parts of a merocyanine spectral sensitizing dye (Lith 454 dye disclosed in U.S. Pat. No. 4,260,677), 40 parts 1,1-bis(2-hydroxy-3,5-dimethylphenyl-3,5,5-trimethyl-hexane) and 10 parts of phthalazinone in a solvent solution of 6.5 parts methyl isobutyl ketone, 21 parts toluene and 60 parts methyl ethyl ketone. The solution was coated at 100 microns wet thickness and dried in a forced air draft at 85° C. for four minutes. A protective top coat of a polyvinyl acetate/polyvinyl chloride copolymer (80/20) in methyl ethyl ketone was coated at 65 microns wet thickness and similarly dried.

To the backside of the support base was coated a unitary strippable layer having the following formulation:

| Component | Amount |
|---|---|
| cellulose acetate ester (Eastman Kodak 395-60) | 10.52 weight percent |
| cellulose acetate propionate (Eastman Kodak 504) | 2.14 weight percent |
| methyl ethyl ketone | 82.57 weight percent |
| octyl phenoxy polyethoxy | 4.77 weight percent |

-continued

| Component | Amount |
|---|---|
| ethanol (Rome and Haas) | |
| Orasol TM Red 2B[a] | 2.5 g/100 g of resinous solution |

[a]Color Index Solvent Red 96 was substituted in another trial with similar results.

The components were mixed on a high shear mixer until no lumps or dye particles were visible. The dispersion was coated at 0.13 mm (5 mil) wet orifice at 14.5 g/m$^2$ (1.35 gm/ft$^2$) coating weight dry for 3 min. at 80° C. (175° F.).

Exposure was for 30 seconds in a tungsten light source and development was for 10–30 seconds using a hot roll or a fluorocarbon bath as a heat source at 127° C. (260° F.). An image with excellent sharpness was obtained. The antihalation layer had an optical density of 0.22.

The one piece strippable layer was easily peeled from the support base.

EXAMPLE 2

A photothermographic element was prepared according to the procedure of Example 1. The backside of the support base was coated with a unitary strippable layer having the following formulation:

| Component | Amount |
|---|---|
| cellulose acetate ester | 10.75 weight percent |
| cellulose acetate propionate | 2.2 weight percent |
| methyl ethyl ketone | 84.59 weight percent |
| di-2-ethylhexylphthalate Flexol TM DOP 20 (Union Carbide) | 2.46 weight percent |
| Orasol TM Blue 23[a] | 2.5 g/100 g resinous solution |

[a]Victoria Pure Blue was substituted in another trial with similar results.

Exposure and development was according to the procedure of Example 1.

An image with excellent sharpness was obtained. The antihalation layer, which was easily peeled from the support base, had an optical density of 0.25. The support had a slightly oily feeling.

EXAMPLE 3

Four photographic elements were prepared according to the procedure of Example 1. Four unitary strippable layers were prepared and coated according to the procedure of Example 1 except that instead of the dye of Example 1, one of the following pigments was utilized in each strippable layer:

| Sample | Pigment | Amount | Particle Size |
|---|---|---|---|
| (1) | carbon black Vulcan TM XC-72 (Cabot) | 6 gm/100 gm | 30 millimicrons |
| (2) | carbon black Monarch TM 800 (Cabot) | 6 gm/100 gm | 17 millimicrons |
| (3) | graphite Dixon 400-09 | 6 gm/100 gm | 60 millimicrons |
| (4) | $TiO_2$ | 10 gm/100 gm | 60 millimicrons |

Exposure and development was according to the procedure of Example 1. An image with excellent sharpness was obtained. The antihalation layers of samples 1–3 had optical densities of 1.0–2.0 and sample 4 had an optical density of 0.26. All dry-strip layers peeled easily from the support base.

EXAMPLE 4

The resistances of antihalation layers having differing loadings of pigment (carbon/graphite) was measured. The strip coat formulation was the same as that of Example 1 except that the carbon/graphite pigment was used instead of the red dye. The pigment was a 0.94 ratio, by weight of carbon/graphite (carbon black, Vulcan TM XC-72; graphite, Dixon 400-09) blended on a high shear homogenizer in toluene to give a well dispersed solution. This solution contained 9.5 weight percent solids and 90.5 weight percent toluene. The pigment solution and the resin of Example 1 were mixed so as to prepare three antihalation layers having carbon/graphite (solids) to total resin (solids) of 0.27, 0.16, and 0.07, respectively. The data is shown in TABLE II.

TABLE II

| Resistance of antihalation layers containing pigment | | |
|---|---|---|
| Carbon/graphite solids | Optical density | Resistance (ohms/square) |
| 0.27 | 2.48 | 6,894 |
| 0.16 | 3.34 | 36,120 |
| 0.07 | 1.43 | greater than 200,000 |

The data of TABLE II show that increasing the carbon/graphite loading of the antihalation layer resulted in lower resistance. All dry-strip layers peeled easily from the support base.

EXAMPLE 5

Comparative delamination resistances and antihalation layer strengths of the construction of Example 1 (Sample A) and of a prior art construction (Sample B) (that of Example 1 of British Patent Specification No. 1,261,102) were determined. In each case the sample size used was 2.5×7.6 cm. A 1.9 cm wide clamp was centered on a 2.5 cm side. Weights were applied starting with 5 g and increased at 10 g increments. The results are shown in TABLE III.

TABLE III

| Delamination resistances and antihalation layer strengths | | |
|---|---|---|
| Sample | Antihalation layer strength (g/cm) | Delamination resistance (g/cm) |
| A | 97 | 14 |
| B | * | * |

*Sample fratured into small irregular pieces during stripping operation and crumbled upon handling.

The data of TABLE III show that the antihalation layer of Sample A had a strength more than six times greater than its delamination resistance. The strip integrity of the present invention antihalation layer was greatly superior to that of the prior art laminate.

Various modifications and alterations of this invention will become apparent to those skilled in the art without departing from the scope and spirit of this invention, and it should be understood that this invention is not to be unduly limited to the illustrative embodiments set forth herein.

I claim:

1. A photothermographic element comprising a. at least one photosensitive layer, capable of being developed by heat after image-wise exposure to radiation in the range of 380 to 800 nm, adhered to one surface of a transparent polymeric support base, and b. a unitary antihalation layer having a resistance greater than 5000 ohms per square, adhered to any surface of said element and dry-strippable therefrom, said antihalation layer having a delaminating resistance in the range of 6 to 50 g/cm, a layer strength in g/cm greater than its delaminating resistance, and an optical density of at least 0.1.

2. The element according to claim 1 wherein said antihalation layer is adhered to the backside of said support base.

3. The element according to claim 1 wherein said antihalation layer is adhered to said imageable layer.

4. The element according to claim 1 wherein said antihalation layer comprises a resin selected from polyester, polyamide, polyolefin, polyvinylchloride, polyether, polycarbonate, gelatin, cellulose ester, polyvinyl acetate, or combinations thereof.

5. The element according to claim 1 wherein said antihalation layer comprises a resin selected from polyvinyl butyrals, polyvinyl alcohols, methyl methacrylate, ethyl methacrylate, ethyl methyl methacrylate, cellulose acetate, cellulose acetate ester, cellulose acetate propionate, cellulose acetate butyrate, or combinations thereof.

6. The element according to claim 1 wherein said support base and said antihalation layers comprise resins having limited natural affinity for each other selected from combinations of poly(ethyleneterephthalate) and a cellulose ester, a polyester and a polyamide, and a polyamide and a polyvinyl acetal.

7. The element according to claim 1 wherein said optical density is at least in the range of 0.3 to 2.0.

8. The element according to claim 4 wherein said antihalation material is selected from the group consisting of carbon black, graphite, titanium dioxide, and dyes.

9. The element according to claim 4 wherein said antihalation material comprises carbon black of average particle size up to 50 microns.

10. The element according to claim 1 wherein said photothermographic layer comprises silver halide, a silver source material and a reducing agent for silver ion in a polymeric binder.

11. The element according to claim 1 further comprising a chemically effective amount of at least one of a surfactant and a plasticizer.

12. The element according to claim 1 wherein said photosensitive layer is selected from layers containing (1) silver halide, (2) a diazonium salt, (3) dye-bleach, (4) an oxidizable leuco dye, (5) pH sensitive materials, or (6) photoinitiated couplers.

* * * * *